US008629082B2

(12) United States Patent
Doi et al.

(10) Patent No.: US 8,629,082 B2
(45) Date of Patent: Jan. 14, 2014

(54) HEAT-SENSITIVE RECORDING MATERIAL

(75) Inventors: Shin-ichi Doi, Amagasaki (JP); Masahiro Morie, Amagasaki (JP); Kenji Muto, Amagasaki (JP); Toshizo Yamamoto, Amagasaki (JP)

(73) Assignee: OJI Holdings Corporation, Tokyo (JP)

( * ) Notice: Subject to any disclaimer, the term of this patent is extended or adjusted under 35 U.S.C. 154(b) by 46 days.

(21) Appl. No.: 13/500,743

(22) PCT Filed: Oct. 8, 2010

(86) PCT No.: PCT/JP2010/067747

§ 371 (c)(1),
(2), (4) Date: Apr. 6, 2012

(87) PCT Pub. No.: WO2011/046080

PCT Pub. Date: Apr. 21, 2011

(65) Prior Publication Data

US 2012/0202686 A1 Aug. 9, 2012

(30) Foreign Application Priority Data

Oct. 14, 2009 (JP) ..... 2009-236834
Nov. 6, 2009 (JP) ..... 2009-254800

(51) Int. Cl.
*B41M 5/337* (2006.01)
*B41M 5/44* (2006.01)

(52) U.S. Cl.
USPC ..... 503/207; 427/152; 503/214; 503/216; 503/226

(58) Field of Classification Search
USPC ..... 503/207, 214, 216, 226
See application file for complete search history.

(56) References Cited

U.S. PATENT DOCUMENTS

| | | | |
|---|---|---|---|
| 5,124,306 | A | 6/1992 | Yamamoto et al. |
| 7,387,984 | B2 | 6/2008 | Yoneshige et al. |
| 8,058,209 | B2 | 11/2011 | Orihara et al. |
| 2002/0094933 | A1 | 7/2002 | Iwasaki et al. |
| 2002/0187897 | A1 | 12/2002 | Ishida et al. |
| 2008/0029024 | A1 | 2/2008 | Morita et al. |
| 2008/0076663 | A1 | 3/2008 | Yoneshige et al. |
| 2008/0206496 | A1 | 8/2008 | Kobori et al. |
| 2008/0220969 | A1 | 9/2008 | Matsunaga et al. |
| 2008/0234128 | A1 | 9/2008 | Orihara et al. |
| 2012/0021900 | A1 | 1/2012 | Orihara et al. |

FOREIGN PATENT DOCUMENTS

| | | | |
|---|---|---|---|
| CN | 1388779 | A | 1/2003 |
| CN | 101259804 | A | 9/2008 |
| GB | 1276381 | | 6/1972 |
| GB | 2085757 | | 5/1982 |
| JP | 49-24133 | | 6/1974 |
| JP | 53-13929 | | 2/1978 |
| JP | 57-39985 | | 3/1982 |
| JP | 2-202481 | | 8/1990 |
| JP | 3-30985 | | 2/1991 |
| JP | 10-193789 | | 7/1998 |
| JP | 11-5366 | | 1/1999 |
| JP | 2001-18526 | | 1/2001 |
| JP | 2001-113226 | | 4/2001 |
| JP | 2001-138632 | | 5/2001 |
| JP | 2001-199163 | | 7/2001 |
| JP | 2001-1991163 | | 7/2001 |
| JP | 2002-160461 | | 6/2002 |
| JP | 2003-72235 | | 3/2003 |
| JP | 2003-112480 | | 4/2003 |
| JP | 2003-182246 | | 7/2003 |
| JP | 2004-136611 | | 5/2004 |
| JP | 2004-216718 | | 8/2004 |
| JP | 2006-247611 | | 9/2006 |
| JP | 3-971453 | | 6/2007 |
| JP | 2007-210328 | | 8/2007 |
| JP | 2007-253369 | | 10/2007 |
| JP | 2008-238160 | | 10/2008 |
| JP | 2008-260275 | | 10/2008 |
| WO | WO 01/76884 | A1 | 10/2001 |

OTHER PUBLICATIONS

Supplementary European Search Report dated Jan. 24, 2013, for the corresponding European Patent Application No. 10823348.7.
International Search Report mailed Dec. 14, 2010, in counterpart International Application No. PCT/JP2010/067747.

*Primary Examiner* — Bruce H Hess
(74) *Attorney, Agent, or Firm* — Kratz, Quintos & Hanson, LLP

(57) ABSTRACT

The present invention provides a heat-sensitive recording material that suffers no defective coating and is superior in color-exhibiting sensitivity, image quality, and chemical resistance. The heat-sensitive recording material successively comprising, on a support, an undercoat layer, a heat-sensitive recording layer containing a leuco dye and a developer, and a protective layer, wherein the heat-sensitive recording layer contains, as a main pigment, kaolin having an average particle diameter of 0.1 to 0.4 μm measured by a sedimentation method in an amount of 4 to 60 mass % based on a total solids content of the heat-sensitive recording layer, and wherein the heat-sensitive recording layer and the protective layer are formed by applying a heat-sensitive recording layer coating composition and a protective layer coating composition by a simultaneous multilayer curtain coating method, and drying resulting coatings.

19 Claims, No Drawings

HEAT-SENSITIVE RECORDING MATERIAL

TECHNICAL FIELD

The present invention relates to a heat-sensitive recording material.

BACKGROUND ART

Heat-sensitive recording materials, which utilize a color-forming reaction between a colorless or pale-colored leuco dye and an organic or inorganic developer in such a manner that the two chromogenic materials are brought into contact with each other by heating to produce a recorded image, are well known. Such heat-sensitive recording materials are relatively inexpensive, and the recording devices are compact and easy to maintain. Therefore, heat-sensitive recording materials have been widely used not only as recording media for facsimile machines, various printers, etc., but also in a variety of fields.

On the other hand, various methods have been used to apply a coating composition onto a base material such as paper, films, etc. Examples of the methods include air knife coating, blade coating, rod coating, roll coating, and bar coating. However, the heat-sensitive recording materials produced by these methods have defects including poor coating quality, interfusion of the coating composition in the upper layer into the under layer, pinholes in an upper layer due to cissing upon application onto the upper layer, and unstable quality due to long-time continuous application. Moreover, these methods also have problems such as limitation of high-speed coating, a decrease in productivity due to frequent applications, and the like.

In contrast to the above coating methods, curtain coating methods (see Patent Document 1, etc.) form a free-falling curtain of a coating composition, in which the composition is applied to a support by impinging it onto the support. Such curtain coating methods are known for their excellent application duality and suitability for high-speed application. Moreover, the curtain coating method may be performed by forming a coating composition film consisting of multilayered coating composition film. This is greatly conducive to an increase in productivity in multilayer coating. According to the curtain coating methods, a coating liquid is formed, into a curtain of fluid while falling from a slit-like coater lip onto a base material to be coated. Therefore, the curtain coating requires precise adjustment in static surface tension, dynamic surface tension, viscosity, etc., so as to improve the film-forming ability of the coating composition or its wettability to the base material, thereby preventing uneven or defective application (see Patent Document 2). In these views, evenness and stability of the application itself are very important, as they greatly affect the performance and production efficiency of the resulting heat-sensitive recording materials.

As described above, since the simultaneous multilayer application by curtain coating method makes it possible to simultaneously apply multiple layers, it is possible to greatly improve productivity. However, after the multilayered coating composition film, is laminated, it is necessary to apply the film onto the support and dry and fix the lamination. If the lamination structure is distorted during lamination or drying and thereby the multiple layers are intermingled, the functions of the respective layers cannot be fully exhibited, thereby impairing the duality as a heat-sensitive recording material. For example, if the layers are intermingled during simultaneous applications, of the heat-sensitive recording layer and the protective layer, it results in uneven film thickness of the protective layer, which decreases chemical resistance to plasticizers or alcohol, or results in insufficient prevention of sticking.

In the field of photosensitive materials or the like in which the simultaneous multilayer application by the curtain coating method has been adopted, the coating composition usually contains gelatin as a binder. Therefore, by cooling a formed layer immediately after the coating liquid thereof is applied onto a support, the gelatin in the coating liquid turns into a gel, allowing the coating liquid to be immobilized. Thereby, the intermingling of the layers is prevented.

In a heat-sensitive recording material, however, the addition of a gelatin in an amount sufficient to immobilize a coating liquid by cooling significantly deteriorates various properties, such as color developing properties and image stability. Methods for immobilizing a coating liquid using a gelatin replacement without sacrificing the foregoing features have not yet been established; therefore, the intermingling of layers cannot be prevented in the same manner as for photosensitive materials.

Several methods have been disclosed as techniques of preventing intermingling of multiple layers of information recording materials such as heat-sensitive recording materials or the inkjet recording materials, thereby desirably obtaining separate layers. For example, Patent Document 3 discloses a method in which, the coating compositions in two adjacent layers become highly viscous with time when they are in contact or mixed. Patent Document 4 discloses a method in which the viscosity of the coating composition that forms multiple layers of the coating composition film is not less than 100 mPa·s, and the surface tension of the coating composition of the undermost layer of the multilayered coating composition film is 18 to 45 mN/m. Further, Patent Document 5 discloses a method in which multiple curtain-coated coating films are dried at a support-to-horizontal surface angle of 45 degrees or less. Patent Document 6 discloses a method in which multiple curtain-coated films are dried within two minutes after the application.

However, in the method disclosed in Patent Document 5, in which the coating compositions in two adjacent layers become highly viscous, the reaction between the two layers generates agglomerates, thereby causing defects in coating. Further, the gelation of a coating liquid may render a long-time continuous operation difficult. Further, in the method disclosed in Patent Document 6, barrier properties to plasticizers or alcohol, and sticking resistance were insufficient. Moreover, the methods disclosed in Patent Documents 5 and 6 suffer from considerable equipment limitations and insufficient quality.

On the other hand, there is disclosed a method of forming an inorganic layer-like compound as one of the multiple layers so as to improve resistance to plasticizers, light stability, and image quality, or to obtain a recording material with a high degree of luster. For example, Patent Document 7 discloses a method of adding mica to the undercoat layer, Patent Documents 8 and 9 disclose a method of adding mica to the middle coating layer, and Patent Document 10 discloses a method of adding mica to one of the layers of the heat-sensitive recording material. Further, Patent Document 11 discloses a method of incorporating kaolin having an aspect ratio of not less than 30 in at least one layer other than the layer between the support and the heat-sensitive recording layer, and Patent Document 12 discloses a method of further providing a protective layer containing kaolin having an aspect ratio of not less than 20 by curtain coating.

However, the method disclosed in Patent Document 7 has a problem in that the increase in viscosity of the undercoat layer decreases its adherence with the support. The methods disclosed in Patent Documents 8, 9, and 10 are effective to some extent. However, depending on the coating method, particularly blade coating, etc., in which a larger shear is created, the orientation of inorganic layered compound particles may be disrupted, resulting in decreased effects of the particles, and the surface strength may be lowered, causing inferior printability, and the like. Furthermore, the methods of Patent Document 11 or 12 using a layer containing kaolin also have several defects including a decrease in printing strength.

Further, Patent Document 13 discloses a method for forming a heat-sensitive recording film material wherein the multilayer simultaneous coating is performed by discharging at least two kinds of coating compositions from separate slits to form a multilayer lamination and making the lamination to free fall on a continuously running web, and wherein the coating liquid which constitutes layers other than a topmost coating layer is formed of a dispersion containing inorganic particles. Furthermore, Patent Document 14 discloses a heat-sensitive recording material comprising a heat-sensitive color-developing layer, a first protective layer, and a second protective layer, which are formed simultaneously by a curtain coating method, wherein the second protective layer contains a specific polyvinyl alcohol and a specific copolymer resin.

Further, there is also disclosed a method of forming a heat-sensitive recording layer using an ethylene-acrylic acid copolymer salt so as to improve resistance to plasticizers, water resistance, heat resistance, and resistance to background fogging. For example, Patent Document 15 discloses a method of providing on a paper support a heat-sensitive recording layer containing, as an adhesive, a water-soluble polymer compound that forms a water resistance film by heating, Patent Document 16 discloses incorporating 1-[α-methyl-α-(4'-hydroxyphenyl)ethyl]-4-(α',α'-bis(4"-hydroxyphenyl)ethyl]benzene and at least one kind of a salt of an olefin/acrylic acid copolymer as an adhesive in a thermal recording layer, and providing a protective layer on the thermal recording layer, and Patent Document 17 discloses a method of incorporating 1,2-bis(phenoxymethyl)benzene and ethylene-acrylic acid copolymer in the heat-sensitive color developing layer. However, these methods have not succeeded in producing desirable heat-sensitive recording materials, particularly in producing heat-sensitive recording materials with superior resistance to plasticizers. Therefore, there as been a demand for further modification of these technologies.

Patent Document 1: Japanese Examined Patent Publication No. S49-24133

Patent Document 2: Japanese Unexamined Patent Publication No. S57-39985

Patent Document 3: Pamphlet of WO 01/076884

Patent Document 4: Japanese Unexamined Patent Publication No. 2001-18526

Patent Document 5: Japanese Unexamined Patent Publication No. 2001-138632

Patent Document 6: Japanese Unexamined Patent Publication No, 2001-113226

Patent Document 7: Japanese Unexamined Patent Publication No, H11-5366

Patent Document 8: Japanese Unexamined Patent Publication No. H10-193789

Patent Document 9: Japanese Unexamined Patent Publication No. 2004-216718

Patent Document 10: Japanese Unexamined Patent Publication No 2001-199163

Patent Document 11: Japanese Patent No. 3971453

Patent Document 12: Japanese Unexamined Patent Publication No. 2007-253369

Patent Document 13: Japanese Unexamined Patent Publication No 2008-238160

Patent Document 14: Japanese Unexamined Patent Publication No. 2008-260275

Patent Document 15: Japanese Unexamined Patent Publication No, S53-013929

Patent Document 16: Japanese Unexamined Patent Publication No H02-202481

Patent Document 17: Japanese Unexamined Patent Publication. No 2003-072235

DISCLOSURE OF THE INVENTION

Technical Problem

An object of the present invention is to provide a heat-sensitive recording material that suffers no detective coating and is superior in color-exhibiting sensitivity, image quality, and chemical resistance.

Technical Solution

The present inventors conducted intensive research on the above problems and found that the problems can be solved by a heat-sensitive recording material successively comprising, on a support, an undercoat layer, a heat-sensitive recording layer containing a leuco dye and a developer, and a protective layer, wherein the heat-sensitive recording layer contains, as a main pigment, kaolin having an average particle diameter of 0.1 to 0.4 μm measured by a sedimentation method in an amount of 4 to 60 mass % based on the total solids content of the heat-sensitive recording layer, and wherein the heat-sensitive recording layer and the protective layer are formed by applying a heat-sensitive recording layer coating composition and a protective layer coating composition by a simultaneous multilayer curtain coating, and drying the resulting coatings. With this finding, the inventors completed the present invention.

Specifically, the present invention is directed to the following heat-sensitive recording materials.

Item 1. A heat-sensitive recording material successively comprising, on a support, an undercoat layer, a heat-sensitive recording layer containing a leuco dye and a developer, and a protective layer.

wherein the heat-sensitive recording layer contains, as a main pigment, kaolin having an average particle diameter of 0.1 to 0.4 μm measured by a sedimentation method in an amount of 4 to 60 mass % based on a total solids content of the heat-sensitive recording layer, and wherein the heat-sensitive recording layer and the protective layer are formed by applying a heat-sensitive recording layer coating composition and a protective layer coating composition by a simultaneous multilayer curtain coating method, and drying the resulting coatings.

Item 2. The heat-sensitive recording material according to Item 1, wherein the heat-sensitive recording layer coating composition comprises at least one cross-linked diphenylsulfone compound represented by the following general formula (I) in an amount of 0.3 to 10 mass % based on a total solids content of the heat-sensitive recording layer,

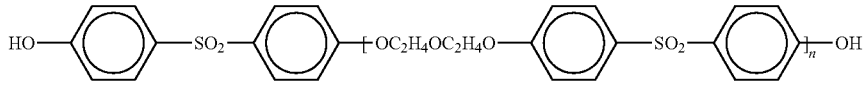

(1)

wherein n is an integer of 1 to 7.

Item 3. The heat-sensitive recording material according to Item 1 or 2, wherein the undercoat layer comprises magnesium carbonate in an amount of 0.1 to 5 mass % based on a total solids content of the undercoat layer.

Item 4. The heat sensitive recording material according to any one of Items 1 to 3, wherein the heat-sensitive recording material further comprises at least an ethylene-acrylic acid copolymer salt as an adhesive of the heat-sensitive recording layer.

Item 5. The heat-sensitive recording material according to Item 4, wherein the ethylene-acrylic acid copolymer salt is an ammonium salt or a sodium salt.

Item 6. The heat-sensitive recording material according to any one of Items 1 to 5, wherein the heat-sensitive recording material further comprises acetoacetyl-modified polyvinyl alcohol having a polymerization degree of 500 to 3000 as an adhesive of the heat-sensitive recording layer.

Item 7. The heat-sensitive recording material according to any one of Items 1 to 6, wherein the heat-sensitive recording material further comprises a butadiene-based copolymer latex as an adhesive of the heat-sensitive recording layer.

Item 8. The heat-sensitive recording material according to any one of Items 1 to 7, wherein the protective layer further comprises at least one polyvinyl alcohol selected from the group consist of acetoacetyl-modified polyvinyl alcohols and diacetone-modified polyvinyl alcohols.

Effect of Invention

The present invention provides a heat-sensitive recording material that is superior in productivity and quality, in particular, superior in chemical resistance, image quality, and printability.

BEST MODE FOR CARRYING OUT THE INVENTION

The neat-sensitive recording material of the present invention is more specifically described below. The heat sensitive recording material of the present invention is formed by successively applying, on a support, an undercoat layer, a heat-sensitive recording layer containing a leuco dye and a developer, and a protective layer. The heat-sensitive recording layer contains kaolin having an average particle diameter of 0.1 to 0.4 μm measured by a sedimentation method in an amount of 4 to 60 mass % based on the total solids content of the heat-sensitive recording layer. The heat-sensitive recording layer and the protective layer are formed by a simultaneous multilayer curtain coating.

Undercoat Layer

The undercoat layer of the present invention is formed by applying an undercoat layer coating composition containing hollow plastic particles and calcined kaolin using blade coating, and then drying the composition. By providing such an undercoat layer between the support and the heat-sensitive recording layer, the present invention accomplishes further improvement in quality. The usable hollow plastic particles may be, for example, hitherto-known fine hollow particles having a shell made of thermoplastic polymer. Examples thereof include particles having a void ratio of from about 50 to 99% and comprising acryl-based resin, styrene resin, acryl-styrene resin, a copolymer resin mainly composed of vinylidene chloride resin and acrylonitrile, a copolymer resin mainly composed of isobornyl methacrylate and acrylonitrile, or the like. The "void ratio" used herein refers to a ratio of the inner diameter of a hollow particle to the outer diameter thereof, which is represented by the following formula.

$$\text{Void Ratio (\%)} = (\text{inner diameter of hollow particle} / \text{outer diameter of hollow particle}) \times 100$$

The content of such hollow plastic particles is preferably 10 to 100 parts by mass relative to 100 parts by mass of the calcined kaolin. By setting the content of hollow plastic particles in the undercoat layer to 100 parts by mass or less when multiple layers of a heat-sensitive recording layer coating composition and a protective-layer coating composition are simultaneously applied by curtain coating, the coating uniformity and the barrier properties are improved. Further, this also ensures sufficient capability to absorb the thermally-fused substances, thereby suppressing so called sticking, i.e., adhesion to the thermal head. Further, by setting the content of the hollow plastic particles to not less than 10 parts by mass, the effect of the present invention is more infallibly ensured. Further, to ensure the desired smoothness of the undercoat layer surface, the hollow plastic particles preferably have an average particle diameter of about 0.4 to 2.0 μm. By adjusting the average particle diameter to about 2.0 μm or less, deficiencies such as streaks and scratches do not occur during application of an undercoat layer coating composition by blade coating. Regarding quality, the smoothness of the undercoat layer surface can be maintained, and application uniformity can be ensured. Thus, in a simultaneous multilayer application of a heat-sensitive recording layer coating composition and a protective layer coating composition by curtain coating, intermingling of the layers can be securely prevented, and the barrier properties are improved.

In the present invention, the hollow plastic particles are preferably used with calcined kaolin. The calcined kaolin preferably has an oil absorbency, which is measured in accordance with JIS-K5101, of 70 ml/100 g or more. Further, the undercoat layer may contain an organic or inorganic pigment. Any general organic or inorganic pigments may be used as long as the desired effects of the present invention are not impaired. In particular, oil-absorbing pigments having an oil absorbency of 40 ml/100 g or more are preferably used. Examples of oil-absorbing pigments include aluminium oxide, calcined diatomaceous earth, aluminum silicate, calcium carbonate, barium sulfate, aluminum hydroxide, kaolin, amorphous silica, talc, and the like. Further, the undercoat layer may also contain solid plastic particles as long as the desired effects of the present invention are not impaired. The total amount of the pigment comprising the foregoing hollow plastic particles and calcined kaolin is preferably 40 to 85 mass %, based on the total, solids of the undercoat layer.

Moreover, it is preferable to use magnesium carbonate in an amount of 0.1 to 5 mass % based on the total solids of the undercoat layer in terms of prevention of background fogging by heating, because the present invention uses kaolin, which is an acidic pigment, as a major pigment of the heat-sensitive recording layer. Background fogging can be prevented by setting the content of magnesium carbonate to not less than 0.1 mass %. Further, it is possible to prevent deterioration in color density by setting the content of magnesium carbonate to not more than 5 mass %.

Examples of binders usable for forming the undercoat layer include, for example, water-soluble polymers and aqueous binders. These binders may be used solely or in combination of two or more. Examples of water-soluble polymers include starch, modified starch, polyvinyl alcohol, modified polyvinyl alcohol, acrylamide, carboxymethylcellulose, and casein. Examples of aqueous binders typically include a synthetic rubber latex and a synthetic resin emulsion, such as styrene-butadiene rubber latex, acrylonitrile-butadiene rubber latex, methyl acrylate-butadiene rubber latex, acetic acid vinyl emulsion, and the like.

The amount of the binder used for the undercoat layer is not limited and may be determined according to the coating film strength or color-developing sensitivity of the heat sensitive recording layer. However, the amount thereof is preferably 3 to 100 mass %, more preferably 5 to 50 mass %, and particularly preferably 7 to 40 mass %, used on 100 mass % of the pigment contained in the undercoat layer. The undercoat layer coating composition may further contain, as necessary, thickeners, waxes, defoaming agents, surfactants, etc.

In the present invention, the application of the undercoat layer coating composition is performed by a method using a blade coater. After application and drying of the undercoat layer, known smoothing treatments using a calendar, etc., may be applied, if necessary.

The method using a blade coater is not limited to the method using a bevel-type blade or a bent-type blade. Examples thereof also include a rod blade method, a bill, blade coating method, etc. Additionally, the usable coaters are not limited to an off-machine coater. An on-machine coater provided with a paper machine may also be used for the application.

The amount of the undercoat layer to be applied is not limited and is suitably determined according to the features of the heat-sensitive recording material. However, the amount thereof is preferably 2 g/m$^2$ or more, more preferably 3 g/m$^2$ or more, and particularly preferably 4 to 10 g/m$^2$ or more.

Generally, when a plurality of coating composition films of a heat-sensitive recording layer coating composition and a protective layer coating composition are simultaneously applied on an undercoat layer, the moisture of the heat-sensitive recording layer coating composition forming a coating film moves down to the undercoat layer during the steps from the application of the coating compositions to the drying of the films. Along therewith, the moisture of the protective layer coating composition above the heat-sensitive recording layer also moves down to the heat-sensitive recording layer. Due to this movement of moisture, components contained in the protective layer other than water, also move into the heat-sensitive recording layer, thereby causing an intermingling of the layers. This deteriorates the harrier properties of the protective layer, resulting in quality degradation, such as in chemical resistance. In the present invention, excellent chemical resistance can be obtained, since hollow plastic particles, which have a specific gravity smaller than those of inorganic pigments or solid, plastic particles, move upward to align along the surface of the undercoat layer during the steps between the application of the undercoat layer coating composition to the drying of the films. This increases the hydrophobicity on the undercoat layer surface, thereby preventing the migration of the moisture of the heat-sensitive recording layer coating composition into the undercoat layer coating composition. Accordingly, the intermingling of the heat-sensitive recording layer coating composition and the protective layer coating composition is prevented, enhancing the barrier properties of the protective layer. For this reason, the use of, for example, solid plastic particles in place of hollow plastic particles significantly deteriorates barrier properties. Further, when calcined kaolin is not used with the hollow plastic particles, the hollow plastic particles extremely increase the hydrophobicity on the surface of the undercoat layer, excessively inhibiting the migration of the moisture of the heat-sensitive recording layer coating composition into the undercoat layer. As a result, the multiple layer coating compositions are likely to be disrupted on the undercoat layer during the steps from the simultaneous multilayer application to the immobilization by drying. This causes an intermingling of the layers, deteriorating not only anti-sticking properties but also barrier properties. In the present invention, the content of the hollow plastic particles is preferably coral to or less than that of calcined kaolin for improving the anti-sticking properties and harrier properties.

Heat-Sensitive Recording Layer

In the present invention, on the undercoat layer, a heat-sensitive recording layer that contains, as a major pigment, kaolin having an average particle diameter of 0.1 to 0.4 μm (measured by a sedimentation method) in an amount of 4 to 60 mass % based on the total solids content of the heat-sensitive recording layer, and a protective layer, are formed by the simultaneous multilayer curtain coating method.

It has been long known that the flat particles of kaolin have advantages as a coating pigment in terms of opaqueness and glossiness in the background and in printed portions. The flat particles ensure higher coatability and smooth coating surface, as well as glossiness in printing.

On the other hand, in the simultaneous multilayer curtain coating method, as described above, after laminating the multiple coating composition films, the lamination is applied onto the support, and then is dried and fixed thereon. However, if the layer configuration is disrupted and the layers are intermingled therebetween while the multiple layers are being laminated and dried, the functions of each layer will no longer be sufficiently exerted, and the quality as a heat-sensitive recording material will be impaired. As a result of an extensive study regarding the pigment of the heat-sensitive recording layer in the simultaneous multilayer curtain coating, the present inventors found that use of kaolin having an average, particle diameter of 0.1 to 0.4 μm (measured by a sedimentation method) suppresses intermingling between the layers, thereby obtaining a heat-sensitive recording material superior in color-developing sensitivity, image quality, chemical resistance, and printability. When the average particle diameter of kaolin is more than 0.4 μm, the color-developing sensitivity, image quality, and printability (surface strength) decrease. When the average particle diameter of kaolin is less than 0.1 μm, the particular flatness of the kaolin particles is impaired, and the layers are more likely to be intermingled upon lamination of the coating compositions.

The content of kaolin is 4 to 60 mass %, more preferably 10 to 55 mass %, and particularly preferably 15 to 50 mass %, based on the total solids content of the heat-sensitive recording layer. When the content of kaolin is less than 4 mass %, the effect of the present invention is not fully ensured. When the content is more than 60 mass %, the viscosity of the coating composition becomes excessively high, or the image quality, color-developing sensitivity, or printability (surface strength) decreases.

Together with the kaolin having an average particle diameter of 0.1 to 0.4 μm (measured by a sedimentation method), it is possible to use other known pigments insofar as the effect of the present invention is not impaired. Examples of such pigments include kaolin having an average particle diameter of more than 0 μm or kaolin having an average particle diameter of less than 0.1 μm (both measured by a sedimentation method), clay, calcium carbonate, magnesium carbonate, aluminum hydroxide, barium sulfate, talc, calcined clay, calcined kaolin, titanium oxide, zinc oxide, diatomaceous earth, particulate anhydrous silica, activated white earth and like inorganic pigments, styrene microballs, nylon powder, polyethylene powder, urea-formalin resin filler, styrene-methacrylic acid copolymer resins, polystyrene resins, raw starch particles, and like organic pigments. However, the content of these other pigments must not be more than the content of the kaolin having an average particle diameter of 0.1 to 0.4 μm (measured by a sedimentation method) so as to obtain the effect of the present invention.

In the present invention, the Brookfield viscosity (B type viscosity) measured by using the Brookfield viscometer (B-type viscometer) of the heat-sensitive recording layer coating composition measured at 25° C. and 60 rpm is preferably in the range of 200 to 1500 mPa·s and more preferably about 300 to 1200 mPa·s. By adjusting the B-type viscosity thereof to 200 mPa·s or more, a heat-sensitive recording layer coating composition is prevented from being partially and unevenly absorbed into an undercoat layer. Thereby, the uniformity in thickness of the protective layer is likely to be maintained, and a decrease in barrier properties can be prevented. By adjusting the B-type viscosity to 1500 mPa·s or less, the heat-sensitive recording layer coating composition can be easily defoamed, suppressing the defects in coating caused by bubbles. Additionally, uneven coating due to streaks in the flow direction can also be prevented. Therefore, a protective layer has a uniform thickness, thereby improving barrier properties and suppressing uneven printing images.

Further, in the present invention, it is preferable to use an ethylene-acrylic acid copolymer salt as an adhesive to be contained in the heat-sensitive recording layer in terms of obtaining a heat-sensitive recording material superior in chemical resistance, particularly in resistance to plasticizers. An ethylene-acrylic acid copolymer salt is a self-emulsifying aqueous solution in which carboxyl-inducing polyethylene rendered water soluble by alkali is highly decentralized. At least a part of the acrylic acid may be substituted with an ethylene-unsaturated carboxylic acid such as maleic acid or methacrylic acid, or other monomers such as acrylic acid ester. Examples of salts include ammonium salts, sodium salts, alkanolamine salts, and aminoethanol salt. Of these, ammonium salts and sodium salts are preferable, as they are conducive to desirable chemical resistance.

The proportion of the ethylene-acrylic acid copolymer salt is preferably about 1 to 30 mass % and more preferably about 3 to 15 mass % based on the total solids content of the heat-sensitive recording layer. By specifying the proportion of the ethylene-acrylic acid copolymer salt about 1 mass or more, it is possible to obtain a heat-sensitive recording material superior in chemical resistance, particularly in resistance to plasticizers. By specifying the proportion of the ethylene-acrylic acid copolymer salt as about 30 mass % or less, it is possible to prevent a decrease in color-developing sensitivity and a decrease in viscosity of the coating composition. Further, this also prevents intermingling of the layers upon simultaneous coating of the protective layer and the heat-sensitive recording layer, thereby preventing a decrease in barrier properties, thus preventing uneven printing.

Further, by preparing a heat-sensitive recording layer coating composition that contains, as a main water-soluble adhesive of the heat-sensitive recording layer, polyvinyl alcohol having a polymerization degree of 500 or more in an amount of 3 to 30 mass % based on the total solids content of the heat-sensitive recording layer, it is possible to obtain a coating composition having a Brookfield viscosity (B-type viscosity) measured by using the Brookfield viscometer (B-type viscometer) at 25° C., 60 rpm in the range of 200 to 1,500 mPa·s. This enables production of a high-quality heat-sensitive recording material, by the curtain coating method at a high productivity.

Such polyvinyl alcohols having a polymerization degree of 500 or more may be any polyvinyl alcohol such as an unmodified polyvinyl alcohol, a modified polyvinyl alcohol, a completely saponified polyvinyl alcohol, or a partially saponified polyvinyl alcohol. Examples of modified polyvinyl alcohols include acetoacetyl-modified polyvinyl alcohols, diacetone-modified polyvinyl alcohols, carboxyl-modified polyvinyl alcohols, and silicon-modified polyvinyl alcohols.

Examples of water-soluble adhesives other than the polyvinyl alcohol having a polymerization degree of 500 or more in the heat-sensitive recording layer include oxidized starches, acid-modified starches, phosphoesterified starches, enzyme modified starches, cation-modified starches, esterified starches, etherified starches, vinyl acetate-modified grafted starches, and like starches, polyvinyl alcohols having a polymerization degree of less than 500, methylcellulose, ethylcellulose, carboxymethyl cellulose, methoxy cellulose, hydroxyethylcellulose, hydroxypropyl methylcellulose, and like cellulose derivatives, sodium polyacrylate, polyacrylamide, polyvinylpyrrolidone, acrylic amide-acrylic ester copolymer, acrylic amigo-acrylic ester-methacrylic acid copolymer, styrene-maleic anhydride copolymer alkali salt, isobutylene-maleic anhydride copolymer alkali salt, sodium alginate, gelatin, casein, and the like. The content of the other water-soluble adhesive is preferably not more than that of the polyvinyl alcohol having a polymerization degree of 500 or more.

In addition to the water-soluble adhesives, polyvinyl acetate, polyurethane, polyacrylic acid, polyacrylic acid ester, polybutyl methacrylate, butadiene-based copolymer, styrene-butadiene copolymer, vinylchloride-vinylacetate copolymer, ethylene-vinylacetate copolymer, styrene-butadiene-acrylic copolymer, and like latexes may be used in combination.

When the butadiene-based copolymer latex is used as an adhesive in the heat-sensitive recording layer, it is preferable to incorporate the latex in an amount of 1 to 30 mass %, and more preferably 3 to 15 mass % based on the total solids content of the heat-sensitive recording layer. The incorporation of the butadiene-based copolymer latex in the specific amount further prevents intermingling of the heat-sensitive recording layer and the protective layer upon the simultaneous coating of the heat-sensitive recording layer and the protective, layer by the curtain coating method, thereby producing a heat-sensitive recording material superior in color-developing sensitivity, image quality, and chemical resistance.

Apart from butadiene monomers, examples of monomers used for the butadiene-based copolymer latex include at least one selected from styrene and substitution products thereof such as styrene, α-methylstyrene, and p-chrolostylene; monocarboxylic acid having a double bond and substitution products thereof such as acrylic acid, methyl acrylate, ethyl, acrylate, butyl acrylate, dodecyl acrylate, octyl acrylate, phenyl acrylate, methacrylic acid, methyl methacrylate, ethyl methacrylate, butyl methacrylate, octyl methacrylate, dimethyl amino ethyl methacrylate, acrylonitrile, methacrylonitrile, and acrylamide; dicarboxylic acid having a double bond and substitution products thereof such as maleic acid, butyl maleate, methyl maleate, dimethyl maleate, and substitution products thereof; vinyl esters such as vinyl chloride, vinyl acetate, and vinyl benzoate; vinyl ketones such as vinyl methyl ketone and vinyl ethyl ketone; and vinyl ethers such as vinylmethyl ether, vinylethyl ether, or vinyl isobutyl ether. A combination of styrene monomer and butadiene monomer is particularly preferable in terms of its rapid exhibition of color-developing sensitivity and superior environmental stability.

Further, in the present invention, it is preferable that the heat-sensitive recording layer coating composition contain 0.3 to 10 mass % of a partially saponified polyvinyl alcohol having a polymerization degree of 300 to 3000 based on the total solids content of the heat-sensitive recording layer so as to improve chemical resistance. It is assumed that the partially saponified polyvinyl alcohol serves as a protective colloid agent of the color component, thereby further improving the chemical resistance. Here, the partially saponified polyvinyl alcohol is used as a protective colloid agent rather than as a viscosity adjuster. The partially saponified polyvinyl, alcohol at least has a polymerization degree of 300. By specifying the amount of the partially saponified polyvinyl alcohol in the range of 0.3 to 10 mass %, the chemical resistance further improves, thereby suppressing a decrease in color-developing sensitivity. Moreover, by specifying the polymerization degree of the partially saponified polyvinyl alcohol in the range of 300 to 3000, a decrease in coating film strength can be suppressed, thereby preventing an increase in viscosity of the heat-sensitive recording layer coating composition. This suppresses a decrease in coating suitability. The saponification degree of the partially saponified polyvinyl alcohol is about 75 to 90 mol %, preferably about 80 to 89 mol %. If the saponification degree is more than 90 mol %, the capability as a protective colloid agent becomes insufficient. If the saponification degree is less than 75 mol %, the coating composition becomes excessively foamy.

Both modified and unmodified partially saponified polyvinyl alcohols may be used as the partially saponified polyvinyl alcohol having a polymerization degree of 300 to 3000. Examples of modified partially saponified polyvinyl alcohol include acetoacetyl-modified polyvinyl alcohol, diacetone modified polyvinyl alcohol, carboxyl-modified polyvinyl alcohol, and silicon-modified polyvinyl alcohols.

When the acetoacetyl-modified polyvinyl alcohol is used as the partially saponified polyvinyl alcohol, the heat-sensitive recording layer preferably contains an acetoacetyl-modified polyvinyl, alcohol having a polymerization degree of 500 to 3000 in an amount of 1 to 30 mass %, and more preferably 3 to 15 mass % based on the total solids content of the heat-sensitive recording layer. The incorporation of the specific amount of acetoacetyl-modified polyvinyl alcohol in the heat sensitive recording layer improves heat resistance (both in the background and recording portion), and also produces a coating composition having a Brookfield viscosity (B-type viscosity) measured by using the Brookfield viscometer (B-type viscometer) at 25° C., 60 rpm, in the range of 500 to 1,500 mPa·s. Accordingly, it is possible to produce a high-quality heat-sensitive recording material at high productivity by the curtain coating method.

The heat-sensitive recording layer of the present invention contains various known leuco dyes and developers. The heat-sensitive recording layer of the present invention may also contain sensitizers, pigments, various auxiliaries, and the like.

For example, a black-color forming leuco dye may be at least one selected from 3-diethylamino-6-methyl-7-anilinofluoran, 3-di(n-butyl)amino-6-methyl-7-anilinofluoran, 3-di(n-pentyl)amino-6-methyl-7-anilinofluoran, 3-(N-ethyl-N-isoamyl amino)-6-methyl-7-anilinofluoran, 3-(N-ethyl-p-toluidino)-6-methyl-7-anilinofluoran, 3-pyrrolidino-6-methyl-7-anilinofluoran, 3-diethylamino-7-(m-trifluoromethylanilino)fluoran, 3-(N-isoamyl-N-ethylamino)-7-(o-chloroanilino)fluoran, 3-(N-ethyl-N-2-tetrahydrofurfurylamino)-6-methyl-7-anilinofluoran, 3-diethylamino-6-chloro-7-anilinofluoran, 3-(N-n-hexyl-N-ethylamino)-6-methyl-7-anilinofluoran, 3-[N-(3-ethoxypropyl)-N-ethylamino]-6-methyl-7-anilinofluoran, 3-[N-(3-ethoxypropyl)-N-methylamino]-6-methyl-7-anilinofluoran, 3-diethylamino-7-(2-chloroanilino)fluoran, 3-di(n-butyl)amino-7-(2-chloroanilino)fluoran, and the like. In addition to black-color-forming leuco dyes, leuco dyes that give the color of red, purplish red, orange, blue, green, etc., may also be used, if necessary.

The leuco dyes usable in the present invention are not limited to the foregoing examples and may be a combination, of two or more. The amount of the leuco dye used is about 3 to 30 mass % based on the total solids of the heat-sensitive recording layer.

According to the present invention, when a leuco dye is used in the form of solid fine particles, the leuco dye may be pulverized using one of various types of wet grinding mills, such as a sand grinder, an attritor, a ball mill, a co-ball mill, and the like, and dispersed in water, which serves as a dispersion medium, with polyacrylamide, polyvinylpyrrolidone, polyvinyl alcohol, sulfone-modified polyvinyl alcohol, and like modified polyvinyl alcohols, methylcellulose, carboxymethyl cellulose, hydroxypropyl methylcellulose, styrene-maleic anhydride copolymer salt and the derivatives thereof, and like water-soluble synthetic polymers. In addition to the above, a surfactant, a defoaming agent, etc., may be, if necessary, added together in the dispersion medium. The thus-obtained dispersion can be used for preparation of a heat-sensitive recording layer coating composition.

Alternatively, it is also possible to use a leuco dye processed into solid fine-particles, which are obtained as follows. A leuco dye is dissolved in a solvent, and the obtained solution is emulsified and dispersed in water using, as a stabilizer, the foregoing water-soluble synthetic high polymer; the solvent is then evaporated from the obtained emulsion. In either case, the average particle diameter of the dispersed leuco dye particles used in a solid fine-particle state is preferably 0.2 to 3.0 μm and more preferably 0.3 to 1.0 μm to obtain a desired color-developing sensitivity.

In the present invention, other than in the form of solid fine-particle as described above, leuco dyes may be used as composite particles comprising an organic polymer and a leuco dye. Such composite particles may be prepared by a known method. For example, the following describes preparation methods of the composite particle in which the organic polymer is at least one member selected from polyurea and polyurea-polyurethane. The composite particles may be prepared by dissolving and mixing, in water-insoluble organic solvent having a boiling point of 100° C. or less, a leuco dye and a polymer forming material capable of producing by polymerization at least one member selected from polyurea and polyurea-polyurethane; emulsifying and dispersing the obtained organic solvent solution in a hydrophilic protective colloid solution such as a polyvinyl alcohol, etc., to adjust the average particle diameter to about 0.5 to 3 μm; further mixing, if necessary, an active substance such as polyamine, etc., therewith; heating the obtained emulsified dispersion to allow the organic solvent to volatilize away; and sequentially polymerizing the polymer-forming material. Alternatively, the composite particles may be prepared by dissolving a leuco dye in a polymer-forming material; emulsifying and dispersing the obtained solution in the same manner as above to adjust the average particle diameter to about 0.5 to μm; and sequentially polymerizing the polymer-forming material.

The usable developers for the heat-sensitive recording layer of the present invention may be selected from known compounds. Specific examples of developers include phenolic compounds, such as 4-tert-butylphenol, 4-acetylphenol, 4-tert-octylphenol, 4,4'-sec-butylidenediphenol, 4-phenylphenol, 4,4'-dihydroxydiphenylmethane, 4,4'-isopropylidenediphenol, 4,4'-cyclohexylidenediphenol, 1,1-bis(4-hydroxyphenyl)-1-phenylethane, 4,4'-dihydroxydiphenylsulfide, 4,4'-thiobis(3-methyl-6-tert-butylphenol), 4,4'-dihydroxydiphenylsulfone, 2,4'-dihydroxydiphenylsulfone, 4-hydroxy-4'-isopropoxydiphenylsulfone, 4-hydroxy-4'-allyloxydiphenylsulfone, and bis(3-hydroxyphenyl sultana, bis(p-hydroxyphenyl)butylacetate, bis(p-hydroxyphenyl) methylacetate, and the like; phenolic compounds, such as 4-hydroxybenzophenone, dimethyl-4-hydroxyphthalate, methyl-4-hydroxy benzoate, propyl-A-hydroxybenzoate, sec-butyl-4-hydroxybenzoate, phenyl-4-hydroxybenzoate, benzyl-4-hydroxybenzyl benzoate, tolyl-4-hydroxybenzoate, chlorophenyl-4-hydroxybenzoate, 4,4'-dihydroxydiphenyl ether, and the like; aromatic carboxylic acids, such as benzoic acid, p-tart-butyl benzoic acid, trichlorobenzoic acid, terephthalic acid, salicylic acid, 3-tert-butylsalicylic acid, 3-isopropylsalicylic acid, 3-benzyl salicylic acid, 3-(α-methylbenzyl)salicylic acid, 3,5-di-tert-butylsalicylic acid, and the like; organic acid substances, such as salts of the phenolic compounds and the aromatic carboxylic acids with a polyvalent metal such as, for example, zinc, magnesium, aluminium, and calcium; and urea compounds, such as N-p-toluenesulfonyl-N'-3-(p-toluenesulfonyloxy)phenylurea, N-(p-toluenesulfonyl)-N'-(p-butoxycarbonyl)urea, and N-p-toluenesulfonyl-N'-phenylurea.

In the present invention, the content of the leuco dye and the developer used in the heat-sensitive recording layer is determined depending on the types of the leuco dye and the developer, and is thus not limited. However, the developer is usually preferably used in an amount of about 1 to 7 parts by mass and more preferably about 1 to 6 parts by mass, per part by mass of the leuco dye. The heat-sensitive recording layer coating composition containing these components is prepared typically by dispersing the leuco dye and the developer together or individually in water, which serves as a dispersion medium, using a stirrer or grinding mill such as a ball mill, an attritor, or a sand mill.

The heat-sensitive recording layer may also contain a sensitizer as required. Specific examples of sensitizers include stearamide, methoxycarbonyl-N-phenyl stearamide, N-benzoyl stearamide, eicosanamide, ethylene bis stearamide, behenamide, methylene bis stearamide, N-methylol stearamide, dibenzyl terephthalate, dimethyl terephthalate, dioctyl terephthalate, benzyl p-benzyloxy benzoate, phenyl 1-hydroxy-2-naphthoate, 2-naphthyl benzyl ether, m-terphenyl, dibenzyl oxalate, di-p-methylbenzyl oxalate, di-p-chlorobenzyl oxalate, p-benzylbiphenyl, tolyl biphenyl ether, di(p-methoxyphenoxyethyl)ether, 1,2-di(3-methylphenoxy) ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(2-methylphenoxy)ethane, p-methylthiophenylbenzyl ether, 1,4-di (phenylthio)butane, p-acetotoluidide, p-acetophenetidide, N-acetoacetyl-b-toluidine, di(β-biphenylethoxy)benzene, b-di(vinyloxyethoxy)benzene, 1-isopropylphenyl-2-phenylethane, and the like. Although the amount of the sensitizers is not limited, it is usually preferably adjusted to 4 parts by mass or less, per part by mass of the developer.

In the present invention, in order to improve the image stability, the heat-sensitive recording layer preferably contains at least one kind of the cross-linked diphenylsulfone compound represented by the following general formula CO in an amount of 0.3 to 10 mass % based on the total solids content of the heat-sensitive recording layer.

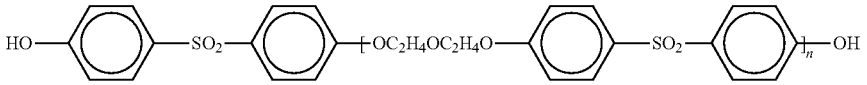

(1)

wherein n is an integer of 1 to 7,

As necessary, the heat-sensitive recording layer may contain other preservability-improving agents to further enhance the preservability of a recorded image insofar as the effect of the present invention is not impaired specific examples of preservability-improving agents include 2'-methylenebis(4-methyl-6-tert-butylphenol), 2,2'-ethylenebis(4-methyl-6-tert-butylphenol), 2,2'-methylenebis(4-ethyl-6-tert-butylphenol), 2,2'-methylenebis(4,6-di-tert-butylphenol), 2,2'-ethylidenebis(4,6-di-tert-butylphenol), 2,2'-ethylidenebis(4-methyl-6-tert-butylphenol), 2,2'-ethylidenebis(4-ethyl-6-tert-butylphenol), 2,2'-(2,2-propylidene)bis(4,6-di-tert-butylphenol), 2,2'-methylenebis(4-methoxy-6-tert-butylphenol), 2,2'-methylenebis(6-tert-butylphenol), 4,4-thiobis(3-methyl-6-tert-butylphenol), 4,4'-thiobis(2-methyl-6-tert-butylphenol), 4,4'-thiobis(5-methyl-6-tert-butylphenol), 4,4'-thiobis(2-chloro-6-tert-butylphenol), 4,4'-thiobis(2-methoxy-6-tert-butylphenol), 4,4'-thiobis(2-ethyl-6-tert-butylphenol), 4,4'-butylidenebis(6-tert-butyl-m-cresol), 1-[α-methyl-α-(4'-hydroxyphenyl)ethyl]-4-[α',α'-bis(4"-hydroxyphenyl)ethyl]benzene, 1,1,3-tris(2-methyl-4-hydroxy-5-cyclohexylphenyl)butene, 1,1,3-tris(2-methyl-4-hydroxy-5-tert-buthylphenyl)butane, 4,4'-thiobis(3-methylphenol), 4,4'-dihydroxy-3,3',5,5'-tetrabromodiphenylsulfone, 4,4'-dihydroxy-3,3',5,5'-tetramethyldiphenylsulfone, 2,2-bis(4-hydroxy-3,5-dibromophenyl)propane, 2,2-bis(4-hydroxy-3,5-dichlorophenyl)propane, 2,2-bis(4-hydroxy-3,5-dimethylphenyl)propane, and like hindered phenolic compounds, N,N'-di-2-naphthyl-p-phenylenediamine, 2,2'-methylenebis(4,6-di-tert-buthylphenyl)sodium phosphate, and the like.

Moreover, as required, the heat-sensitive recording layer may also contain various auxiliaries. For example, surfactants, waxes, metallic soap, defoaming agents, fluorescent dyes, coloring dyes, cross-linking agents, viscosity modifiers, and the like are appropriately added.

The heat-sensitive recording material of the present invention may be a multicolor heat-sensitive recording material for the purpose of adding value. Generally, multicolor heat-sensitive recording materials are based on an attempt to utilize a heating temperature difference or a thermal energy difference. Multicolor heat-sensitive recording materials are typically configured in such a manner that a high-temperature color-forming layer and a low-temperature color-forming layer, in which each individually develops a different color, are sequentially laminated on a support. Such multicolor heat-sensitive recording materials can be roughly classified into two types, i.e., a decolorization type and a color mixing type, and are produced by a method using a microcapsule and a method using composite particles comprising an organic polymer and a dye precursor.

Because the heat-sensitive recording layer of the present invention is formed by curtain coating, the heat-sensitive recording layer coating composition preferably contains a surfactant so as to adjust the surface tension thereof to stabilize the curtain film. Examples of surfactants include alkali metal, salts of sulfosuccinic acid, alkylbenzene sulfonate, acetylene glycol compounds, fluorochemical surfactants, silicon surfactants, phosphoric-ester surfactants, ether-type surfactants, betaine, aminocarboxylate, imidazoline derivatives, and like ampholytic surfactants, etc. Of these, particularly preferred is dialkyl sulfosuccinate represented by the following general formula (2) in term of stability of the curtain film. The salts are preferably alkali metal salt, or ammonium salt. The alkyl group preferably has 2 to 20 carbon atoms and more preferably 4 to 10 carbon atoms. Specific examples thereof include isobutyl croup, hexyl group, cyclohexyl group, octyl group, isooctyl group, 2-ethylhexyl group, and the like. The surfactant is preferably used in an amount of about 0.05 to 3.0 mass % based on the total solids of the heat-sensitive recording layer. By adjusting the amount to 0.05 mass % or more, the effect of the surfactant can be fully exhibited and the surface tension is effectively lowered; thereby, deficiencies of curtain film can be avoided. By adjusting the amount to 3.0 mass % or less, application defects due to foaming of coating composition may be prevented. In view of the balance between the effects of inhibiting deficiencies of curtain film and the properties, etc., of the coating composition, the surfactants are preferably used in a total amount of about 0.10 to 2.0 mass %.

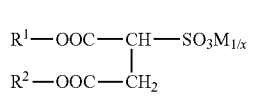

(2)

wherein, $R^1$ and $R^2$ represent the same or different $C_{2-20}$ aliphatics or $C_{2-20}$ cycloaliphatic hydrocarbon croup, M represents a hydrogen atom or a cation, and x represents 1 or 2.

In the present invention, it is preferable to perform simultaneous multilayer application of the heat-sensitive recording layer and the protective layer by curtain coating in terms of an increase in stability of curtain film, an increase in production efficiency, and reduction in energy consumption during manufacturing. In the present invention, the curtain coating used for application of the heat-sensitive recording layer refers to a method in which a coating composition is applied onto a support in a non-contact manner, i.e., the coating composition is applied onto the support as a free-falling curtain. The usable curtain coating methods are not particularly limited, and known methods, such as slide curtain coating, couple curtain coating, twin curtain coating, etc., may be employed. Further, as disclosed in Japanese Unexamined. Patent Publication No. 2006-247611, a coating composition may be elected downward from a curtain head onto a slope to form a coating layer thereon, subsequently forming a curtain film in a downward-facing curtain guide provided at the terminal end of the slope, and then falling onto the surface of a web. The amount of the heat-sensitive recording layer coating composition, to be applied is not limited, but is preferably about 1 to 12 g/m$^2$ and more preferably about 2 to 10 g/m$^2$ on a dry weight basis to ensure the desired quality. Where necessary, two or more heat-sensitive recording layers may be formed, each layer varying in composition and application amount. The various conditions, such as the concentration of the coating composition, the application speed, width of the curtain film, and angle of fall, are preferably determined depending on each curtain coating method and the coater to be used. Since the above curtain coating methods are contour coating in a non-contact manner, layers having a uniform thickness can be obtained. Comparatively, in coating methods performed in a contact manner, such as blade coating, bar coating, air-knife coating, and the like, layers having an uneven thickness are formed, due to the uneven surface (irregularity in surface) of the support. In this view, when the same amount of coating composition is used in an application, curtain coating methods provide excellent image quality, while improving the preservability of printed image.

Protective Layer

According to the present invention, at least one or more protective layers may be laminated on the heat-sensitive recording layer. The protective layer may be one used in the hitherto known heat-sensitive recording materials. The protective layer mainly contains an adhesive and a pigment in particular, the protective layer preferably contains a lubricant, such as polyolefin wax, zinc stearate, etc., for the purpose of preventing sticking to a thermal head. The protective layer may also contain a UV absorber. Additionally, a glossy protective layer may be prepared for the purpose of adding value.

In the present invention, by incorporating a polyvinyl alcohol having a polymerization degree of 1000 to 3000 as a water-soluble adhesive in the protective layer in an amount of 15 to 50 mass % based on the total solids of the protective layer, the effects of the present invention can be further improved. Examples of the polyvinyl alcohols having a polymerization degree of 1000 to 3000 include completely or partially saponified polyvinyl alcohols, acetoacetyl-modified polyvinyl alcohols, diacetone-modified polyvinyl alcohols, carboxy-modified polyvinyl alcohols, silicon-modified polyvinyl alcohols, and the like.

Of these, the acetoacetyl-modified polyvinyl alcohols and the diacetone-modified polyvinyl alcohols are preferable in terms of improvement in barrier properties of the protective layer surface and improvement in preservability such as chemical resistance.

The content of the water-soluble polymer in total is preferably about 10 to 80 mass % and particularly preferably about 20 to 75 mass % based on the total solids of the protective layer.

If the content is less than 10 mass %, not only do the barrier properties become insufficient, but the surface strength decreases, thereby more easily generating paper dust. On the other hand, if the content as more than 80 mass %, sticking may more easily occur.

Examples of adhesives other than water-soluble polymer include polyvinyl acetates, polyurethanes, polyacrylic acids, polyacrylic acid esters, polybutyl methacrylate, styrene-butadiene copolymers, vinyl chloride-vinyl acetate copolymers, ethylene-vinyl acetate copolymers, styrene-butadiene-acrylic copolymers, and like latexes. These can be used singly or in combination.

Examples of pigments include inorganic particles such as calcium carbonate, zinc oxide, aluminum oxide, titanium dioxide, amorphous silica, synthetic mica, aluminum hydroxide, barium sulfate, talc, kaolin, clay, and calcined kaolin, and organic pigments, such as nylon resin filler, urea-formalin resin filler, raw starch particles, and the like.

Of these, kaolin and aluminum hydroxide are preferable, since deterioration of the barrier properties against plasticizers, oils, etc., can be suppressed therewith, and the recording density deterioration can also be suppressed.

The pigment is preferably used in an amount of about 5 to 80 mass %, and more preferably about 10 to 70 mass %, based on the total solids of the protective layer.

If the amount is less than 5 mass %, the smoothness with the thermal head decreases, thereby inducing sticking while increasing residue adhesion to the thermal, head. If the amount is more than 80 mass %, the barrier properties decrease, thereby significantly decreasing the functions as the protective layer.

Examples of auxiliaries include zinc stearate, calcium stearate, polyethylene waxes, carnauba waxes, paraffin waxes, ester waxes, and like lubricants, sodium alkylbenzene sulfonate, sodium dioctyl sulfosuccinate, sulfone-modified polyvinyl alcohols, sodium polyacrylate acetylene glycol compounds, fluorochemical surfactants, silicon surfactants, phosphoric-ester surfactants, ether-type surfactants, betaine, aminocarboxylate, imidazoline derivatives, and like ampholytic surfactants, etc.; glyoxals, boric acids, dialdehyde starches, methylol ureas, epoxy compounds, hydrazine compounds, and like water-resistant additives (cross-linking agents), hydrophobic polycarboxylic acid copolymers, UV absorbers, fluorescent dyes, coloring dyes, mold lubricants, antioxidants, and the like. The amount of auxiliaries used may be suitably determined from a broad range.

In the present invention, the protection layer is applied together with the neat-sensitive recording layer by simultaneous multilayer curtain coating. Such application provides an effect of increasing the flow rate of the curtain and thereby stabilizing the curtain film, thus suppressing application defects, and it provides an effect of improving barrier properties of the protective layer and improving production efficiency, thereby further reducing the energy consumption. Examples of coaters usable in curtain coating include, but are not limited to, an extrusion hopper-type curtain coater, a slide hopper-type curtain coater, and those disclosed in the aforementioned Japanese Unexamined Patent Publication No. 2006-247611.

The amount of the protective layer coating composition to be applied is not limited, but is preferably about 0.3 to 10 g/m$^2$ and more preferably about 0.5 to 8 g/m$^2$ on a dry weight basis to ensure the desired quality. Where necessary, two or more protective layers may be formed, each layer varying in composition and application amount.

After the application and subsequent drying of the coating composition, a smoothing treatment, preferably a calender treatment, is performed before use.

In the present invention, the heat-sensitive recording material is allowed to undergo further treatments to provide better functions for the purpose of adding value. For example, an adhesive, a remoistening adhesive, a delayed-tack adhesive, or the like may be applied on the rear face so that the heat-sensitive recording material may be used as an adhesive paper, remoistening adhesive paper, or delayed-tack paper. Further, a magnetic treatment may be applied to the neat-sensitive recording material so that a layer capable of magnetic recording may be formed on the rear face. In particular, heat-sensitive recording materials subjected to adhesion or magnetic treatment are effectively used as heat-sensitive labels, heat-sensitive magnetic tickets, etc. Additionally, the heat-sensitive recording material may be arranged, and the rear face of the heat-sensitive recording material may have a function of a thermal transfer paper, ink-jet printing paper, carbonless paper, electrostatic recording paper, or xerography paper. Thereby, a material capable of double-sided recording may be produced. The heat-sensitive recording material may of course be produced as a double-sided heat-sensitive recording material.

EXAMPLE

Hereinafter, the present invention will be described in more detail with reference to the Examples. The present invention, however, is not limited to those examples in the Examples, "parts" and "6" represent "parts by mass" and "percent by mass", respectively, unless otherwise specified.

Measurement of Average Particle Diameter of Pigment by Sedimentation Method

According to the sedimentation method, the average particle diameter of the pigment was measured as an average particle diameter ($d_{50}$) of 50 cumulative mass %, using a Sedigraph 5100 (Micromeritics, USA) and using a pigment-containing dispersion as a sample. The pigment-containing dispersion used in the measurement was prepared by diluting a pigment slurry, which was obtained by adding 0.1 parts by mass of a dispersant (sodium polyacrylate) to 100 parts by mass of a pigment, with an 0.1% aqueous solution of phosphate dispersant (Nankarin) so that the dispersion had a pigment solid content concentration of about 4 to 8%.

Example 1

Preparation of Undercoat Layer Coating Composition

A composition comprising 60 parts of calcined kaolin having an oil absorption of 110 ml/100 q, 80 parts of a hollow plastic particle emulsion (trade name: AE852, solids content: 26%; void ratio: 80%; average particle diameter: 1.0 μm; manufactured by JSR), 1 part of light magnesium carbonate, 20 parts of a styrene-butadiene-acrylonitrile copolymer latex having a solids content of 50%, which was used as an adhesive, 20 parts of a 5% aqueous solution of carboxymethyl cellulose (trade name: Cellogen 7A, manufactured by Dai-Ichi Kogyo Seiyaku Co., Ltd.), 25 parts of a 20% aqueous solution of oxidized starch (trade name: Oji Ace A, manufactured by Oji Cornstarch Co., Ltd.), and 90 parts of water was homogeneously mixed and stirred to obtain an undercoat layer coating composition.

Preparation of Dye Precursor/Sensitizer Dispersion (Solution A)

A composition comprising 25 parts of 3-di(n-butyl)amino-6-methyl-7-anilinofluoran, 20 parts of 1,2-di(3-methylphenoxy)ethane, 25 parts of a 20% aqueous solution or sulfone-modified polyvinyl alcohol, and 30 parts of water was pulverized by means of a sand mill to an average particle diameter of 0.9 μm. Thereby, a dye precursor dispersion (Solution A) was obtained.

Preparation of Developer Dispersion (Solution B)

A composition comprising 45 parts of 2,2'-bis(4-hydroxyphenyl)propane, 25 carts of a 20% aqueous solution of sulfone-modified polyvinyl alcohol, and 30 parts of water was pulverized by means of a sand mill to an average particle diameter of 1.5 μm. Thereby, a developer dispersion (Solution B) was obtained.

Preparation of Preservability-Improving Dispersion (Solution C)

A composition comprising 45 parts of the =pound (trade name: D-90, total content of the compounds of the formula (I) wherein a of 1-7 is 87 wt. %, produced by Nippon Soda Co., Ltd.) represented by a general formula (I), 25 parts of a 20% aqueous solution of sulfone-modified polyvinyl alcohol, and 30 parts of water was pulverized by means of a sand mill to an average particle diameter of 1.5 μm. Thereby, a preservability-improving dispersion (Solution C) was obtained.

Preparation of Heat-Sensitive Recording Layer Coating Composition 40 parts of Solution. A, 50 parts of Solution B, 10 parts of Solution C, 50 parts of a 50% aqueous dispersion of kaolin (primary kaolin, product name: UW-90, manufactured by Engelhard Corporation, an average particle diameter $d_{50}$: 0.32 μm), 20 pats of an 20% aqueous solution of a completely saponified polyvinyl alcohol (trade name: PVA-110; polymerization degree: 1000; saponification degree: 98.5 mol %; manufactured by Kuraray Co., Ltd.), 30 parts of a 15% aqueous solution of a partially saponified polyvinyl alcohol (trade name: PVA-205; polymerization degree: 500; saponification degree: 88 mol %; manufactured by Kuraray Co., Ltd.), 15 parts of a styrene-butadiene copolymer latex (trade name: L-1571, a solids concentration: 48%, manufactured by Asahi Kasei Chemicals), 10 parts of a 30% aqueous dispersion of adipic acid dihydrazide, 10 parts of a 30% dispersion of zinc stearate, 5 parts of a 10% aqueous solution of sodium dioctyl sulfosuccinate (trade name: SN wet OT-70, manufactured by San Nopco Co.) were sequentially added and mixed, thereby obtaining a heat-sensitive recording layer coating composition having a B-type viscosity of 700 mPa·s at 25° C., 60 rpm. The average particle diameter of the heat-sensitive recording layer coating composition (measured with a SALD-2200 (manufactured by Shimadzu Corp., refractive index: 1.7) was 2.11 μm.

Preparation of Protective Layer Coating Composition 50 parts of a 50% aqueous dispersion of kaolin (primary kaolin, trade name: UW-90, same as above) was mixed with 600 parts of a 10% aqueous solution of acetoacetyl-modified polyvinyl alcohol (trade name: Gohsefimer 21-410; polymerization degree: 2400, manufactured by Nippon Synthetic Chemical industry Co., Ltd.), 25 parts of zinc stearate (trade name: Hidorin Z-8-36; solids content: 36%; manufactured by Chukyo Yushi Co., Ltd.), and 20 parts of a 5% aqueous solution of sodium dioctyl sulfosuccinate (trade name: SN wet OT-70, manufactured by San Nopco Limited). The mixture was stirred to give a protective layer coating composition.

Preparation of Undercoat Layer

Using a blade coater, the undercoat layer coating composition was applied onto one side of a 60 g/m$^2$-weight high-quality paper with an amount of 7 g/m$^2$ on a dry weight basis and was dried. Thereby, an undercoat layer-coated base paper was prepared.

Preparation of Heat-Sensitive Recording Material

The heat-sensitive recording layer coating composition and the protective layer coating composition were simultaneously applied by simultaneous multilayer curtain coating onto the undercoat layer-coated base paper prepared as above in amounts of 4.0 g/m$^2$ and 2.0 g/m$^2$ on a solids basis, respectively, at an application rate of 600 m/min, using a slide hopper-type curtain coater, thereby forming a coating film in which the heat-sensitive recording layer coating composition and the protective layer coating composition are laminated in this order from the base paper. The resulting lamination was then dried and supercalendered to obtain a heat-sensitive recording material.

Example 2

A heat-sensitive recording material was obtained in the same manner as in Example 1, except that the heat-sensitive recording layer coating composition having a B-type viscosity of 500 mPa·s at 25° C., 60 rpm, was prepared using kaolin (particulate kaolin, trade name: Astra-Sheen, Imerys Performance Minerals, average particle diameter $d_{50}$: 0.18 μm) instead of the kaolin (primary kaolin, trade name: UW-90, same as above). The average particle diameter of the heat-sensitive recording layer coating composition (measured with a SALD-2200 (manufactured by Shimadzu Corp.), refractive index: 1.7) was 1.90 μm.

Example 3

A heat sensitive-recording material was obtained in the same manner as in Example 1, except that the heat-sensitive recording layer coating composition having a B-type viscosity of 550 mPa·s at 25° C., 60 rpm, was prepared using 30 parts of the 50% aqueous solution of kaolin (primary kaolin, trade name: UW-90, same as above) instead of 50 parts thereof, and adding 20 parts of a 50% aqueous dispersion of light calcium carbonate (trade name: Brilliant-15, manufactured by Shiraishi Kogyo Kaisha, Ltd., average particle diameter $d_{50}$: 0.30 μm). The average particle diameter of the heat-sensitive recording layer coating composition (measured with a SALD-2200 (manufactured by Shimadzu Corp.), refractive index: 1.7) was 2.01 μm.

Example 4

A heat-sensitive recording material was obtained in the same Tanner as in Example 1, except that the heat-sensitive recording layer coating composition having a B-type viscosity of 750 mPa·s at 25° C., 60 rpm, was prepared using 120 parts of the 50% aqueous solution of kaolin (primary kaolin, trade name: UW-90, same as above) instead of 50 parts thereof, and the coating amount of the heat sensitive recording layer was adjusted to 5.5 g/m$^2$ so as to equalize the amount of color component per unit area with that in Example 1. The average particle diameter of the heat-sensitive recording layer coating composition (measured with a SALD-2200 (manufactured by Shimadzu Corp.), refractive index: 1.7) was 1.65 μm.

Example 5

A heat-sensitive recording material was obtained in the same manner as in Example 1, except that the heat-sensitive recording layer coating composition having a B-type viscosity of 500 mPa·s at 25° C., 60 rpm, was prepared using 50 parts of a 15% aqueous solution of a partially saponified polyvinyl alcohol (trade name: PVA-205; same as above) without using; 20 parts of a 15% aqueous solution of a completely saponified polyvinyl alcohol (product name: PVA-110, same as above). The average particle diameter of the heat-sensitive recording layer coating composition (measured with a SALD-2200 (manufactured by Shimadzu Corp.), refractive index: 1.7) was 2.12 μm.

Example 6

A heat-sensitive recording material was obtained in the same manner as in Example 1, except that the heat-sensitive recording layer coating composition having a B-type viscosity of 800 mPa·s at 25° C., 60 rpm, was prepared using 50 parts of a 15% aqueous solution of a completely saponified polyvinyl alcohol (product PVA-110, same as above) without using 30 parts of a 15% aqueous solution of a partially saponified polyvinyl alcohol (trade name: PVA-205; same as above). The average particle diameter of the heat-sensitive recording layer coating composition (measured with a SALD-2200 (manufactured by Shimadzu Corp), refractive index: 1.7) was 2.09 μm.

Example 7

A heat-sensitive recording material, was obtained in the same manner as in Example 1, except that the undercoat layer coating composition was prepared by adding 1 part of dimethylolurea and homogeneously stirring the mixture, and the heat-sensitive recording layer coating composition having a B-type viscosity of 700 mPa·s at 25° C., 60 rpm, was prepared using 20 parts of a 15% aqueous solution of a completely saponified acetoacetyl-modified polyvinyl alcohol (trade name: Z-200, manufactured by Nippon Synthetic Chemical Industry Co., Ltd., polymerization degree: 1000) instead of 20 parts of a 15% aqueous solution of a completely saponified polyvinyl alcohol (product name: PVA-110, same as above) without using 10 parts of a 30% aqueous dispersion of adipic acid dihydrazide.

Example 8

A heat-sensitive recording material was obtained in the same manner as in Example 1, except that the heat-sensitive recording layer coating composition having a B-type viscosity of 650 mPa·s at 25° C., 60 rpm, was prepared without adding 20 parts of Solution C. The average particle diameter of the heat-sensitive recording layer coating composition (measured with a SALD-2200 (manufactured by Shimadzu Corp.), refractive index: 1.7) was 2.11 μm.

Example 9

A heat-sensitive recording material was obtained in the same manner as in Example 1, except that the undercoat layer coating composition was prepared by adding 40 parts of solid plastic particles (trade name: Glossdell 130S; solids content: 52%, manufactured by Mitsui Chemicals, Inc.) instead of hollow plastic particles.

Example 10

A heat-sensitive recording material was obtained in the same manner as in Example 1, except that the undercoat layer coating composition was prepared without adding 1 part of light magnesium carbonate.

Example 11

A heat-sensitive recording material was obtained in the same manner as in Example 1, except that the undercoat layer-coated base paper was obtained by applying and drying the undercoat layer coating composition using an air-knife coater instead of a blade coater.

Example 12

A heat-sensitive recording material, was obtained in the same manner as in Example 1, except that the protective layer was prepared using 600 parts of a 10% aqueous solution of diacetone-modified polyvinyl alcohol (trade name: DF-24, manufactured by Japan Vam & Poval Co., Ltd.; polymerization degree: 2400) instead of acetoacetyl-modified polyvinyl alcohol.

Comparative Example 1

A heat-sensitive recording material was obtained in the same manner as in Example 1, except that the heat-sensitive recording layer coating composition was prepared using 50 parts of a 50% aqueous dispersion of light calcium carbonate (product name: Brilliant-15, same as above) instead of 50 parts of a 50% aqueous dispersion of kaolin (primary kaolin, trade name: UW-90, same as above). The average particle diameter of the heat-sensitive recording layer coating composition (measured with a SALD-2200 (manufactured by Shimadzu Corp.), refractive index: 1.7) was 2.09 μm.

Comparative Example 2

A heat-sensitive recording material was obtained in the same manner as in Example 1, except that the heat-sensitive recording layer coating composition was prepared using 50 parts of a 50% aqueous dispersion of kaolin (delaminated kaolin, trade name: Contour 1500, Imerys Performance Minerals, average particle diameter $d_{50}$: 0.46 μm) instead of 50 parts of a 50% aqueous dispersion of kaolin (primary kaolin, trade name: UW-90, same as above). The average particle diameter of the heat-sensitive recording layer coating composition (measured with a SALD-2200 (manufactured by Shimadzu Corp.), refractive index: 1.7) was 2.21 μm.

Comparative Example 3

A heat-sensitive recording material was obtained in the same manner as in Example 1, except that the heat-sensitive recording material was produced by sequentially applying the heat-sensitive recording layer coating composition and the protective layer coating composition using a single-layer curtain coater instead of a multilayer curtain coater.

Comparative Example 4

A heat-sensitive recording material was obtained in the same manner as in Example 1, except that the heat-sensitive recording maternal was produced by sequentially applying the heat-sensitive recording layer coating composition and the protective layer coating composition using a rod blade coater instead of a multilayer curtain coater.

The following evaluation tests were conducted for the heat-sensitive recording materials obtained in Examples 1 to 1.2 and Comparative Examples 1 to 4. Table 1 shows the results.

Recording Sensitivity

Each heat-sensitive recording material was subjected to color development at an applied energy of 0.27 mJ/dot using a thermal recording tester (TH-PMD, manufactured by Ohkura Electric Co., Ltd.), and the density of a solid recorded portion was measured with a Macbeth densitometer (trade name: RD914, manufactured by Macbeth Co., Ltd.) in visual mode. The recorded portion is required to be 1.30 or more from a practical viewpoint.

Printing Quality

The printing quality of each recorded portion was visually evaluated.

A: Excellent image quality with no missing portions

B: Good image quality with a few missing portions

C: Image quality at a practical use level with some missing portions

D: Bad image quality with an extremely large amount of missing portions, making it unsuitable for practical use Chemical Resistance The recorded portion of the above heat-sensitive recording material that was subjected to color development at 0.27 mJ/dot was wrapped from above and below with a vinyl chloride wrapping film (trade name: Hi-S Soft TM350, produced by Nippon Carbide Industries Co., Ltd.), which was then wrapped around an acrylic cylinder having a diameter of about 5 cm. The resulting cylinder was left to stand at 40° C. for 24 hours, and the density of the recorded portion was measured with a Macbeth densitometer (trade name: RD914, manufactured by Macbeth) in visual mode. Further, the preservation rate of the recorded portion was found by the following equation. The heat-sensitive recording material satisfies a practical level if the thus measured recording density and the preservation rate are not less than 1.00 and not less than 75%, respectively.

Preservation Rate (%)=Measured Value (Recording Density)÷Recording Density before the Treatment×100

Background Fogging

Each of the obtained heat-sensitive recording materials was allowed to stand at 60° C. for 24 hours, and the density of each background portion was measured with a Macbeth densitometer (trade name: RD914, manufactured by Macbeth) in visual mode. If the density of the background portion is more than 0.2, the background fogging of the heat-sensitive recording material is considered problematic.

Printability

Each of the obtained heat-sensitive recording materials was subjected to printing using an RI tester (manufactured by Akira Seisakusho Corporation) with a pick test ink (TOKA printing in super deluxe T=13), and the surface strength was visually evaluated.

A: No removal of the printed surface

B: Slight removal of the printed surface

C: Removal of the printed surface at several points but a practical, usable level D: Removal of the entire printed surface observed, making it unsuitable for practical use Defective Coating 1000 m of each resulting heat-sensitive recording material was tested for defective coating due to deficiencies of curtain film.

A: No defective coating due to deficiencies of curtain film was observed.

B: Defective coating due to deficiencies of curtain film was observed, making it unsuitable for practical use.

TABLE 1

| | Recording Sensitivity | Image Quality | Recording Density | Preservation Rate | Background Fogging | Printability | Defective Coating |
|---|---|---|---|---|---|---|---|
| | | | Chemical Resistance | | | | |
| Example 1 | 1.40 | A | 1.30 | 93 | 0.10 | A | A |
| Example 2 | 1.40 | A | 1.25 | 89 | 0.10 | A | A |
| Example 3 | 1.37 | A | 1.24 | 91 | 0.09 | A | A |
| Example 4 | 1.38 | A | 1.28 | 93 | 0.10 | A | A |
| Example 5 | 1.35 | A | 1.30 | 96 | 0.10 | A | A |
| Example 6 | 1.38 | A | 1.25 | 91 | 0.10 | A | A |
| Example 7 | 1.39 | A | 1.29 | 93 | 0.10 | A | A |
| Example 8 | 1.40 | A | 1.24 | 89 | 0.08 | A | A |
| Example 9 | 1.36 | B | 1.23 | 90 | 0.10 | A | A |
| Example 10 | 1.40 | A | 1.30 | 93 | 0.14 | A | A |
| Example 11 | 1.35 | B | 1.22 | 90 | 0.11 | B | A |
| Example 12 | 1.39 | A | 1.29 | 93 | 0.10 | A | A |
| Comparative Example 1 | 1.36 | A | 0.88 | 65 | 0.09 | A | A |
| Comparative Example 2 | 1.34 | C | 1.19 | 89 | 0.10 | D | A |
| Comparative Example 3 | 1.37 | B | 1.20 | 88 | 0.11 | C | B |
| Comparative Example 4 | 1.37 | B | 0.95 | 69 | 0.11 | D | A |

Example 13

A heat-sensitive recording material was obtained in the same manner as in Example 1, except that the heat-sensitive recording layer coating composition was prepared in the following method.

Preparation of Heat-Sensitive Recording Layer Coating Composition 40 parts of Solution A, 50 parts of Solution B, 10 parts of Solution C, 50 parts of a 50% aqueous dispersion of kaolin (primary kaolin, product name: UW-90, manufactured by Engelhard Corporation, average particle diameter $d_{50}$: 0.32 μm), 20 parts of a 25% aqueous solution of ammonium salt of an ethylene-acrylic acid copolymer (product name: Zaikthene AC-HW-10, Sumitomo Seika Chemicals Co., Ltd.), 50 parts of a 10% aqueous solution of acetoacetyl-modified polyvinyl alcohol (trade name: Gohsefimer Z-410; polymerization degree: 2400, manufactured by Nippon Synthetic Chemical Industry Co., Ltd.), 10 parts of a butadiene-based copolymer latex (trade name: L-1571, composition: styrene/butadiene/carboxylic acid, solids concentration: 48%, manufactured by Asahi Kasei Corporation), 10 parts or a 30% aqueous dispersion of adipic acid dihydrazide, 10 parts of a 30% dispersion of zinc stearate, and 5 parts of a 10% aqueous solution of sodium dioctyl sulfosuccinate (trade name: SN wet OT-70, manufactured by San. Mapco Co.) were sequentially added and mixed, thereby obtaining a heat-sensitive recording layer coating composition having a B-type viscosity of 700 mPa·s at 25° C., 60 rpm. The average particle diameter of the heat-sensitive recording layer coating composition (measured with a SALD-2200 (manufactured by Shimadzu Corp), refractive index: 1.7) was 2.11 μm.

Example 14

A heat-sensitive recording material was obtained in the same manner as in Example 13, except that the heat-sensitive recording layer coating composition having a B-type viscosity of 700 mPa·s at 25° C., 60 rpm, was prepared using 20 parts of a 25% aqueous solution of sodium salt of an ethylene-acrylic acid copolymer (product name: Zaikthene NC, Sumitomo Seika Chemicals Co., Ltd.) instead of 20 parts of a 25% aqueous solution of ammonium salt of an ethylene-acrylic acid copolymer (product name: Zaikthene AC-HW-10, same as above). The average particle diameter of the heat-sensitive recording layer coating composition (measured with a SALD-2200 (manufactured, by Shimadzu Corp.), refractive index: 1.7) was 2.10 μm.

Example 15

A heat-sensitive recording material was obtained in the same manner as in Example 13, except that the heat-sensitive recording layer coating composition having a B-type viscosity of 700 mPa·s at 25° C., 60 rpm, was prepared using 20 parts of a 25% aqueous solution of alkanolamine salt of an ethylene-acrylic acid copolymer (product name: Zaikthene LC, Sumitomo Seika Chemicals Co., Ltd.) instead of 20 parts of a 25% aqueous solution of ammonium salt of an ethylene-acrylic acid copolymer (product name: Zaikthene AC-HW-10, saris as above). The average particle diameter of the heat-sensitive recording layer coating composition (measured with a SALD-2200 (manufactured by Shimadzu Corp) refractive index: 1.7) was 2.12 μm.

Example 16

A heat-sensitive recording material was obtained in the same manner as in Example 13, except that the heat-sensitive recording layer coating composition having a B-type viscosity of 400 mPa·s at 25° C., 60 rpm, was prepared using 20 parts of a styrene-butadiene copolymer latex (product name: L-1571, same as above) without using a 10% aqueous solution of acetoacetyl-modified polyvinyl alcohol (product name: Gohsefimer Z-410, same as above). The average particle diameter of the heat-sensitive recording layer coating composition (measured with a SALD-2200 (manufactured by Shimadzu Corp.), refractive index: 1.7) was 2.10 μm.

Example 17

A heat-sensitive recording material was obtained in the same manner as in Example 13, except that the heat-sensitive recording layer coating composition having a B-type viscosity of 400 mPa·s at 25° C., 60 rpm, was prepared without using a 10% aqueous solution of acetoacetyl-modified polyvinyl alcohol (product name: Gohsefimer Z-410, same as above) and using 40 parts of a 25% aqueous solution of: ammonium salt of an ethylene acrylic acid copolymer (product name: Zaikthene AC-MW-10, same as above). The average particle diameter of the heat-sensitive recording layer coating composition (measured with a SAID-2200 (manufactured by Shimadzu Corp.), refractive index: 1.7) was 2.09 μm.

Example 18

A heat-sensitive recording material was obtained in the same manner as in Example 13, except that the heat-sensitive recording layer coating composition having a B-type viscosity of 750 mPa·s at 25° C., 60 rpm, was prepared without using a butadiene-based copolymer latex (product name: L-1571, same as above) and using: 100 parts of a 10% aqueous solution of acetoacetyl-modified polyvinyl alcohol (product name: Gohsefimer Z-410, same as above). The average particle diameter of the heat sensitive recording layer coating composition (measured with a SALD-2200 (manufactured by Shimadzu Corp.), refractive index: 1.7) was 2.11 μm.

Example 19

A heat-sensitive recording material was obtained in the same manner as in Example 13, except that the heat-sensitive recording layer coating composition having a B-type viscosity of 400 mPa·s at 25° C., 60 rpm, was prepared without using a 10% aqueous solution of acetoacetyl-modified polyvinyl alcohol (product name: Gohsefimer Z-410, same as above) and a butadiene based copolymer latex (product name: L-1571, same as above) and using 60 parts of a 25% aqueous solution of ammonium salt of an ethylene-acrylic acid copolymer (product name: Zaikthene AC-HW-10, same as above). The average particle diameter of the heat-sensitive recording layer coating composition (measured with a SALD-2200 (manufactured by Shimadzu Corp.), refractive index: 1.7) was 2.13 μm.

Example 20

A heat-sensitive recording material was obtained in the same manner as in Example 13, except that the heat-sensitive recording layer coating composition having a B-type viscosity of 500 mPa·s at 25° C., 60 nm, was prepared using kaolin (particulate kaolin, product name: Astra-Sheen, Imerys Performance Minerals, average particle diameter $d_{50}$: 0.18 μm) instead of kaolin (primary kaolin, trade name: UW-90, same as above). The average particle diameter of the heat-sensitive recording layer coating composition (measured with a SALD-2200 (manufactured by Shimadzu Corp.), refractive index: 1.7) was 1.90 μm.

Example 21

A heat-sensitive recording material was obtained in the same manner as in Example 13, except that the heat-sensitive recording layer coating composition having a B-type viscosity of 650 mPa·s at 25° C., 60 rpm, was prepared without adding 20 parts of Solution C. The average particle diameter of the heat-sensitive recording layer coating composition (measured with a SALD-2200 (manufactured by Shimadzu Corp.), refractive index; 1.7) was 2.11 μm.

Example 22

A heat-sensitive recording material was obtained in the same manner as in Example 13, except that the undercoat layer coating composition was prepared by adding 40 parts of solid plastic particles (trade name: Glossdell 130S; solids content: 52%, manufactured by Mitsui Chemicals, Inc.) instead of hollow plastic particles.

Example 23

A heat-sensitive recording material was obtained in the same manner as in Example 13, except that the undercoat layer coating composition was prepared without adding 1 part of light magnesium carbonate.

Example 24

A heat-sensitive recording material was obtained in the same manner as in Example 13, except that the protective layer was prepared using 600 parts of a 10% aqueous solution of diacetone-modified polyvinyl alcohol (trade name: DF-24, manufactured by Japan Vam & Poval Co., Ltd.; polymerization degree: 2400) instead of acetoacetyl-modified polyvinyl alcohol.

Comparative Example 5

A heat-sensitive recording material was obtained in the same manner as in Example 13, except that the heat-sensitive recording layer coating composition was prepared using 50 parts of a 50% aqueous dispersion of light calcium carbonate (trade name: Brilliant-15, manufactured by Shiraishi Kogyo Kaisha, Ltd., average particle diameter $d_{50}$: 0.30 μm) instead of 50 parts of a 50% aqueous dispersion of kaolin (primary kaolin, trade name: SW-90, same as above). The average particle diameter of the heat-sensitive recording layer coating composition (measured with a SALD-2200 (manufactured by Shimadzu Corp.), refractive index: 1.7) was 2.09 μm.

Comparative Example 6

A heat-sensitive recording material was obtained in the same manner as in Example 13, except that the heat-sensitive recording layer coating composition was prepared using 50 parts of a 50% aqueous dispersion of kaolin (delaminated kaolin, trade name: Contour 1500, Imerys Performance Minerals, average particle diameter $d_{50}$: 0.46 μm) instead of 50 parts of a 50% aqueous dispersion of kaolin (primary kaolin, trade name: UN-90, same as above). The average particle diameter of the heat-sensitive recording layer coating composition (measured with a SALD-2200 (manufactured by Shimadzu Corp.), refractive index: 1.7) was 2.21 μm.

Comparative Example 7

A heat-sensitive recording material was obtained in the same manner as in Example 13, except that the heat-sensitive recording material was produced by sequentially applying the heat-sensitive recording layer coating composition and the protective layer coating composition using a single-layer curtain coater instead of a multilayer curtain coater.

Comparative Example 8

A heat-sensitive recording material was obtained in the same manner as in Example 13, except that the heat-sensitive recording material was produced by sequentially applying the heat-sensitive recording layer coating composition and the protective layer coating composition using a rod blade coater instead of a multilayer curtain coater.

The following evaluation tests were conducted for the 343 heat-sensitive recording materials obtained in Examples 13 to 24 and Comparative Examples 5 to 8. Table 1 shows the results. The recording sensitivity, printing property, and defective coating were measured and evaluated by the same methods as in Example 1.

Chemical Resistance

The recorded portion of the above heat-sensitive recording material that was subjected to color development at 0.27 mJ/dot was triply wrapped from above and below with a vinyl chloride wrapping film (trade name: Hi-S Soft TM350, produced by Nippon. Carbide Industries Co., Ltd.), which was then wrapped around an acrylic cylinder having a diameter of about 5 cm. The resulting cylinder was left to stand at 50° C. for 36 hours, and the density of the recorded portion was measured with a Macbeth densitometer (trade name: RD914, manufactured by Macbeth) in visual mode. Further, the preservation rate of the recorded portion was found by the following equation. The heat-sensitive recording material satisfies a practical level if the thus-measured recording density and the preservation rate are not less than 1.00 and not less than 70%, respectively.

Preservation Rate (%)=Measured Value (Recording Density)÷Recording Density before the Treatment×100

Heat Resistance and Background Fogging

The recorded portion of each heat-sensitive recording material that was subjected to color development at 0.27 mJ/dot and the blank portion of the heat-sensitive recording material were allowed to stand at 70° C. for 24 hours, and the density of each recorded portion and each blank portion was measured with a Macbeth densitometer (trade name: RD914, manufactured by Macbeth) in visual mode. If the recording density is not less than 1.20, heat resistance is ensured. If the density of the background portion is not more than 0.2, background fogging is not considered problematic.

TABLE 2

| | | | Chemical Resistance | | | | |
|---|---|---|---|---|---|---|---|
| | Recording Sensitivity | Image Quality | Recording Density | Preservation Rate | Heat Resistance | Background Fogging | Defective Coating |
| Example 13 | 1.40 | A | 1.21 | 86 | 1.40 | 0.10 | A |
| Example 14 | 1.40 | A | 1.19 | 85 | 1.40 | 0.10 | A |
| Example 15 | 1.39 | A | 1.10 | 79 | 1.38 | 0.09 | A |
| Example 16 | 1.41 | A | 1.19 | 84 | 1.29 | 0.14 | A |
| Example 17 | 1.38 | A | 1.19 | 86 | 1.29 | 0.13 | A |
| Example 18 | 1.36 | B | 1.03 | 76 | 1.36 | 0.09 | A |
| Example 19 | 1.35 | B | 1.24 | 92 | 1.28 | 0.13 | A |
| Example 20 | 1.40 | A | 1.17 | 84 | 1.40 | 0.10 | A |
| Example 21 | 1.40 | A | 1.05 | 75 | 1.40 | 0.08 | A |
| Example 22 | 1.36 | B | 1.16 | 85 | 1.40 | 0.10 | A |

TABLE 2-continued

| | Recording Sensitivity | Image Quality | Recording Density | Preservation Rate | Heat Resistance | Background Fogging | Defective Coating |
|---|---|---|---|---|---|---|---|
| | | | Chemical Resistance | | | | |
| Example 23 | 1.39 | A | 1.21 | 87 | 1.39 | 0.14 | A |
| Example 24 | 1.39 | A | 1.20 | 86 | 1.39 | 0.10 | A |
| Comparative Example 5 | 1.25 | C | 0.69 | 51 | 1.36 | 0.09 | A |
| Comparative Example 6 | 1.34 | C | 0.90 | 67 | 1.33 | 0.10 | A |
| Comparative Example 7 | 1.37 | B | 0.80 | 58 | 1.36 | 0.11 | B |
| Comparative Example 8 | 1.37 | C | 0.74 | 54 | 1.37 | 0.11 | A |

INDUSTRIAL APPLICABILITY

The present invention forms a protective layer and a heat-sensitive recording layer containing a specific kaolin by way of a simultaneous multilayer curtain coating method, thereby providing a heat-sensitive recording material that suffers no defective coating, and it is superior in recording sensitivity, image quality, chemical resistance, background heat resistance, and printability.

The invention claimed is:

1. A heat-sensitive recording material successively comprising, on a support, an undercoat layer, a heat-sensitive recording layer containing a leuco dye and a developer, and a protective layer, wherein the heat-sensitive recording layer contains, as a main pigment, kaolin having an average particle diameter of 0.1 to 0.4 μm measured by a sedimentation method in an amount of 4 to 60 mass % based on a total solids content of the heat-sensitive recording layer, and wherein the heat-sensitive recording layer and the protective layer are formed by applying a heat-sensitive recording layer coating composition and a protective layer coating composition by a simultaneous multilayer curtain coating method, and drying the resulting coatings.

2. The heat-sensitive recording material according to claim 1, wherein the heat-sensitive recording layer coating composition comprises at least one cross-linked diphenylsulfone compound represented by a following general formula (I) in an amount of 0.3 to 10 mass % based on a total solids content of the heat-sensitive recording layer,

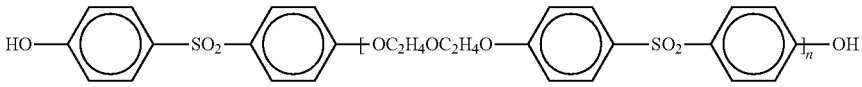

(1)

wherein n is an integer of 1 to 7.

3. The heat-sensitive recording material according to claim 2, wherein the undercoat layer comprises magnesium carbonate in an amount of 0.1 to 5 mass % based on a total solids content of the undercoat layer.

4. The heat-sensitive recording material according to claim 2, wherein the heat-sensitive recording material further comprises at least an ethylene-acrylic acid copolymer salt as an adhesive of the heat-sensitive recording layer.

5. The heat-sensitive recording material according to claim 4, wherein the ethylene-acrylic acid copolymer salt is an ammonium salt or a sodium salt.

6. The heat-sensitive recording material according to claim 1, wherein the undercoat layer comprises magnesium carbonate in an amount of 0.1 to 5 mass % based on a total solids content of the undercoat layer.

7. The heat-sensitive recording material according to claim 6, wherein the heat-sensitive recording material further comprises at least an ethylene-acrylic acid copolymer salt as an adhesive of the heat-sensitive recording layer.

8. The heat-sensitive recording material according to claim 7, wherein the ethylene-acrylic acid copolymer salt is an ammonium salt or a sodium salt.

9. The heat-sensitive recording material according to claim 6, wherein the heat-sensitive recording material further comprises acetoacetyl-modified polyvinyl alcohol having a polymerization degree of 500 to 3000 as an adhesive of the heat-sensitive recording layer.

10. The heat-sensitive recording material according to claim 6, wherein the heat-sensitive recording material further comprises a butadiene-based copolymer latex as an adhesive of the heat-sensitive recording layer.

11. The heat-sensitive recording material according to claim 6, wherein the protective layer further comprises at least one polyvinyl alcohol selected from the group consist of acetoacetyl-modified polyvinyl alcohols and diacetone-modified polyvinyl alcohols.

12. The heat-sensitive recording material according to claim 1, wherein the heat-sensitive recording material further comprises at least an ethylene-acrylic acid copolymer salt as an adhesive of the heat-sensitive recording layer.

13. The heat-sensitive recording material according to claim 12, wherein the ethylene-acrylic acid copolymer salt is an ammonium salt or a sodium salt.

14. The heat-sensitive recording material according to claim 12, wherein the heat-sensitive recording material further comprises acetoacetyl-modified polyvinyl alcohol having a polymerization degree of 500 to 3000 as an adhesive of the heat-sensitive recording layer.

15. The heat-sensitive recording material according to claim 12, wherein the heat-sensitive recording material further comprises a butadiene-based copolymer latex as an adhesive of the heat-sensitive recording layer.

16. The heat-sensitive recording material according to claim 12, wherein the protective layer further comprises at least one polyvinyl alcohol selected from the group consist of acetoacetyl-modified polyvinyl alcohols and diacetone-modified polyvinyl alcohols.

17. The heat-sensitive recording material according to claim 1, wherein the heat-sensitive recording material further comprises acetoacetyl-modified polyvinyl alcohol having a polymerization degree of 500 to 3000 as an adhesive of the heat-sensitive recording layer.

18. The heat-sensitive recording material according to claim 1, wherein the heat-sensitive recording material further comprises a butadiene-based copolymer latex as an adhesive of the heat-sensitive recording layer.

19. The heat-sensitive recording material according to claim 1, wherein the protective layer further comprises at least one polyvinyl alcohol selected from the group consist of acetoacetyl-modified polyvinyl alcohols and diacetone-modified polyvinyl alcohols.

* * * * *